United States Patent [19]

Nisida

[11] Patent Number: 4,792,061

[45] Date of Patent: Dec. 20, 1988

[54] COLLAPSIBLE TUBE WITH MEMBRANE CAP

[75] Inventor: Hirotaka Nishida, Osaka, Japan

[73] Assignee: Taisei Kako Co., Ltd., Osaka, Japan

[21] Appl. No.: 877,526

[22] Filed: Jun. 23, 1986

[30] Foreign Application Priority Data

Nov. 19, 1984 [JP] Japan ..... 59-169975

[51] Int. Cl.[4] ..... B65D 35/08

[52] U.S. Cl. ..... 222/107; 222/541

[58] Field of Search ..... 222/92, 107, 541, 215, 222/206; 215/31; 220/67, 75–76, 465

[56] References Cited

U.S. PATENT DOCUMENTS

| | | | |
|---|---|---|---|
| 3,260,411 | 7/1966 | Dobson | 222/107 |
| 4,011,968 | 3/1977 | McGhie et al. | 222/107 |
| 4,185,757 | 1/1980 | Schultz | 222/107 |
| 4,548,338 | 10/1985 | Sander | 222/107 |
| 4,568,001 | 2/1986 | Sander | 222/107 |

FOREIGN PATENT DOCUMENTS

| | | | |
|---|---|---|---|
| 835901 | 1/1939 | France | 222/107 |
| 136083 | 5/1919 | United Kingdom | 222/92 |

*Primary Examiner*—Michael S. Huppert
*Attorney, Agent, or Firm*—Wenderoth, Lind & Ponack

[57] ABSTRACT

A collapsible squeeze tube for containing creamlike substances including a cylindrical body formed of a laminated sheet, a head formed of synthetic resin fixed on the cylindrical body, and a membrane cap closing and opening at a top end of the head. The head includes a shoulder member on the cylindrical body and a mouth member integrally formed on the shoulder member. The head includes bonded inside and outside layer members, one being formed of a waterproof synthetic resin material and the other being formed of a gas impermeable synthetic resin material. A membrane cap closing the opening is formed of a thin laminated sheet having a synthetic resin film on an outward surface thereof fitted between an upper end surface of the inside layer member and a receiving seat surface of the outside layer member, and welded to the outside layer member. In the preferred embodiment, the laminated sheet of the cylindrical body has an inside synthetic resin layer overlapping and welded to the outside surface of the outside layer member of the head over the shoulder member thereof.

16 Claims, 3 Drawing Sheets

COLLAPSIBLE TUBE WITH MEMBRANE CAP

BACKGROUND OF THE INVENTION

The present invention relates to a collapsible squeeze tube for housing cream-like substances, such as foodstuffs and toothpaste, therein, and in particular to an improvement of such a tube with a blank cap which includes a body made by turning a laminated aluminium sheet provided with a synthetic resin film on opposite sides thereof into a cylindrical body, the body being provided with a synthetic resin head which includes a mouth member and a shoulder member which are integrally molded, and the mouth member is closed with a thin sheet member, connected to the upper end thereof.

A conventional method of making a collapsible squeeze tube, in which a body of the tube is made by turning a laminated aluminium sheet provided with a synthetic resin film on opposite sides thereof into a cylindrical body, the body being provided with a synthetic resin head, wherein a mouth member and a shoulder member are integrally molded, connected to the upper end thereof, has been widely used in the manufacture of a squeeze tube. However, with such a tube, since the head is formed of a single synthetic resin material, it is impossible to simultaneously make the tube both highly gas tight (gas impermeable) and highly waterproof. Normally a synthetic resin material is wanting in either waterproofness or gas tightness.

Accordingly, in order to assure high degrees of both gas tightness (gas impermeability) and waterproofness, means as shown in FIG. 3 has been proposed. In particular, a laminated aluminium sheet 6 provided with a polyolefin type synthetic resin film laminated on both sides thereof is molded from a push die 8 in a drawing manner along the internal surface of a head 7 (the internal surface of a shoulder member 7*a* and a mouth member 7*b* of the head 7), whereby the head is covered all over the internal surface thereof and at the same time a blank cap 9 is formed.

However, with the tube formed by the abovedescribed prior method there has been the possibility that the synthetic resin film layer may be damaged due to an abnormal extension and bending in the process of drawing and pressing the laminated aluminium sheet 6 to the internal surface of the head, whereby this metallic layer is subjected to corrosion causing it to lose its gas tightness, and to the pin hole phenomenon (the phenomenon where holes, which seem to be broken through with a pin point, are generated) since the blank cap portion is also extended by the drawing process.

With this prior method, there is also the following important problem: Since the laminated aluminium sheet is extended by a drawing process, it is necessary to form the synthetic resin film to be laminated on the laminated aluminium sheet, of extensible polyolefin type synthetic resin materials. Thus, polyethylene and the like have usually been used. However, polyethylene has a poor adherence to aluminium and it is partially stripped during extension even though adhesives are used according to circumstances. In addition, there is the possibility that the comparatively highly penetrative contents filling the tube may penetrate the resin film layer to chemically act upon the boundary surface of the resin film layer and the aluminium surface, thereby remarkably reducing the adhesion strength, or stripping the resin film layer. When this stripping phenomenon occurs on the lower surface of the blank cap 9, or the resin film layer is brought into a condition of being liable to strip, since the lower film layer 9*a* is pushed down by a projection member 10, as shown in FIG. 4, the blank cap 9 cannot be broken through by the projection member 10.

Thus, it is a main object of the present invention to provide a squeeze tube with a blank cap which can solve the problems of the conventional tube.

BRIEF DESCRIPTION OF THE DRAWINGS

These and other aspects of the invention are made more apparent from the following detailed description of the preferred embodiments when taken with the accompanying drawings in which.

BRIEF SUMMARY OF THE INVENTION

The collapsible squeeze tube according to the invention includes a cylindrical body formed of a laminated sheet, including a metallic layer, an inside synthetic resin layer laminated onto an inside surface of the metallic layer and an outside synthetic resin layer laminated onto an outside surface of said metallic layer. The tube also includes a head formed of synthetic resin fixed on the cylindrical body. The head includes a shoulder member fixed on said cylindrical body and a mouth member integrally formed on said shoulder member and having an upper end opening. The head is formed of an inside layer member and an outside layer member bonded together. One of these layer members is formed of a waterproof synthetic resin material and the other is formed of a gas impermeable synthetic resin material. By providing the head in two layers respectively waterproof and gas impermeability, the waterproofness and gas impermeability of the tube is increased.

The tube also includes a membrane cap closing the opening in the head. The membrane cap is formed of a thin laminated sheet including an aluminum sheet, a synthetic resin film laminated on the outwardly facing surface of the aluminum sheet, and an adhesive resin film laminated on the inwardly facing surface of the aluminum sheet. A circumferential edge portion of the laminated sheet is fitted between an upper end surface of the inside layer member and a receiving seat surface of the outside layer member. The synthetic resin film on the membrane cap is welded to the outer layer member, thereby to seal the top of the tube without the need to abnormally extend or bend the membrane cap and thereby avoid subjecting it to corrosion or the pin hole phenomenon.

DETAILED DESCRIPTION OF THE PREFERRED EMBODIMENTS

The preferred embodiments of the present invention will be below described with reference to the drawings.

Figure 1:
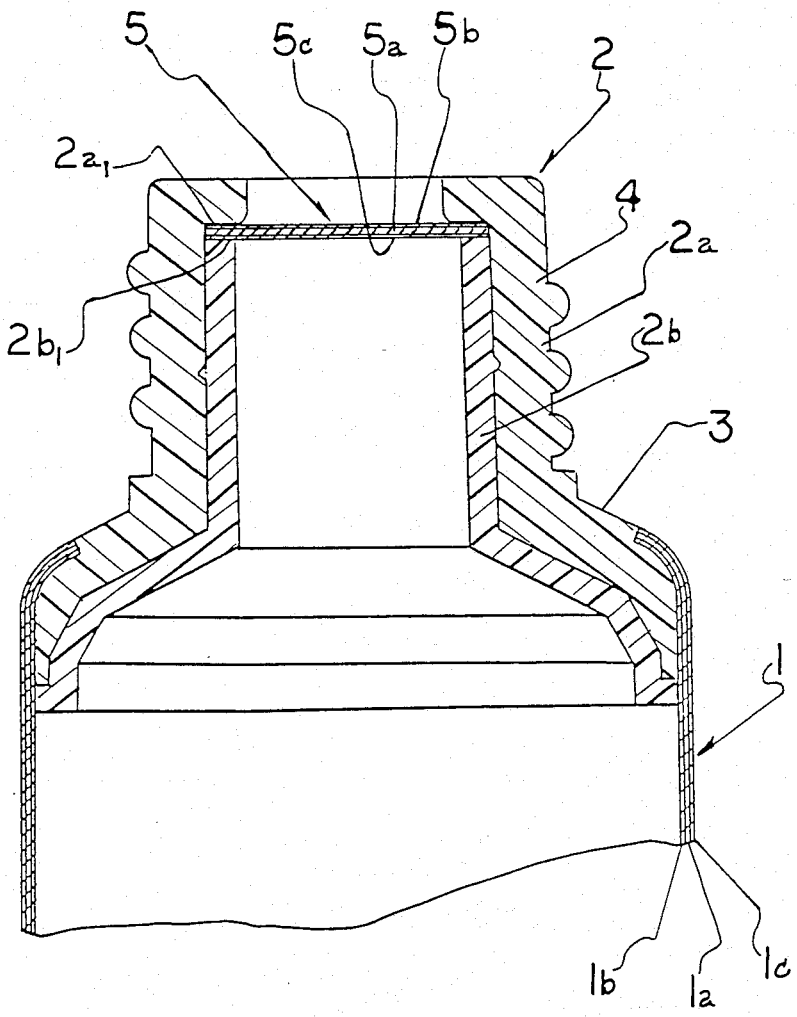
FIG. 1 is a sectional view of one preferred embodiment of the present invention.

Referring now to FIG. 1, reference numeral 1 designates a body of a tube formed by cylindrically winding a laminated aluminium sheet 1*a* provided with synthetic resin films 1*b*, 1*c* made of polyethylene, polypropylene or the like laminated on both sides thereof, followed by welding overlapped edges to each other. In addition, a plurality of said synthetic resin film layers may be laminated. Also, the inside or internal surface film lb of the tube body is formed of a synthetic resin material of the same quality as an outside layer member 2*a* of a head, which will be described below, so as to be easily weldable to said outside layer member 2*a*.

Reference numeral 2 designates an integrally molded head made of synthetic resins provided with a shoulder member 3 extending downward and a mouth member 4 narrowed by pressing at its top end (lip), the slightly narrowed upper end portion of the body 1 being overlapped on the shoulder member 3 of the head to weld the adjacent resins to each other.

The head 2 is a bonded body comprising two members—the outside layer member 2*a* and the inside or internal layer member 2*b*, both the outside layer member 2*a* and the internal layer member 2*b* being separately molded and closely engaged with each other.

The outside layer member 2*a* is formed of synthetic resin materials, such as polyethylene and polypropylene, which provides waterproofness, while the internal layer member 2*b* is formed of synthetic resin materials, such as thermoplastic synthetic resins such as polyethylene terephthalate and polybutylene terephthalate, or thermosetting synthetic resin such as melamine resins, urea resins and phenolic resins, which provides gas impermeability or impenetrability.

In addition, the head 2 is provided with a membrane cap or blank cap 5 for closing the mouth member 4, and is formed at the upper end portion of the mouth member 4. The blank cap 5 is formed of a thin aluminium sheet 5*a* as a substrate member provided with a synthetic resin film 5*b* made of synthetic resin materials, for example low-density polyethylene or polypropylene having the same quality as the outside layer member 2*a*, laminated on the upper surface of aluminium sheet 5*a* and welded to the outside layer member 2*a*, and a film 5*c* made of adhesive resin materials such as polyurethane synthetic resins and epoxy-contained synthetic resins laminated on the lower surface of aluminium sheet 5*a*.

As to the thickness of said blank cap 5, the substrate member thereof, the aluminium sheet 5*a* is 20 to 100μ thick, most preferably 40μ thick, the upper surface film 5*b* being 10 to 50μ thick, most preferably 20μ thick, and the lower surface film 5*c* being 3 to 15μ thick, most preferably 7μ thick.

In addition, the blank cap is positioned between a receiving-seat surface $2a_1$ formed on the internal surface of the outside layer member 2*a* and the upper end surface $2b_1$ of the internal layer member 2*b* at the circumferential portion thereof, the upper surface film 5*b* of the blank cap being welded to said outside layer member 2*b*. In this case, since the outside layer member 2*a* is made of polyethylene or polypropylene and the upper surface film 5*b* of the blank cap is made of low-density polyethylene or polypropylene having the same quality as the polyethylene or polypropylene forming the outside layer member 2*a*, both the outside layer member 2*a* and the upper surface film 5*b* of said blank cap can be completely welded to each other, thereby achieving a complete seal of the welded portion. In addition, in the assembly of the head 2, the blank cap 5 can be easily positioned between the receiving-seat surface $2a_1$ and the upper end surface $2b_1$ of the internal layer member by placing the blank cap 5 on the receiving-seat surface $2a_1$ of the outside layer member 2*a* and putting the internal layer member 2*b* in the outside layer member 2*a*. Also, the welding of the upper surface film *a* of the blank cap to the outside layer member 2*a* may be carried out by heating by means of a heater when the internal layer member 2*b* is placed in the outside layer member or by high-frequency heating after the internal layer member 2*b* has been fully inserted into the outside layer member 2*a*.

Furthermore, in the preferred embodiment as shown in FIG. 1, since the adjacent area between the outside layer member 2*a* of the head 2 and the film 1*b* of the body 1 is large and both the outside layer member 2*a* of the head 2 and the film 1*b* of the body 1 are formed of the same material, the adhesion between them is remarkably high, but since the contact area between the internal layer member 2*b* and the film 1*b* of the body 1 is very small and they are formed of different materials, the adhesion between these members is low. Accordingly, in the case where the contents of the tube generates a gas having a high pressure, the body 1 is expanded by the high pressure gas to extend the outside layer member 2*a* outwardly. This causes a gap to be produced between the outside layer member 2*a* and the internal layer member 2*b* permitting the gas to flow upwardly through this gap and seep through the waterproof but not gas impermeable outside layer member 2*a*, thereby leaking out. As a result, the property of gas impermeability of the tube is lost.

Figure 2:
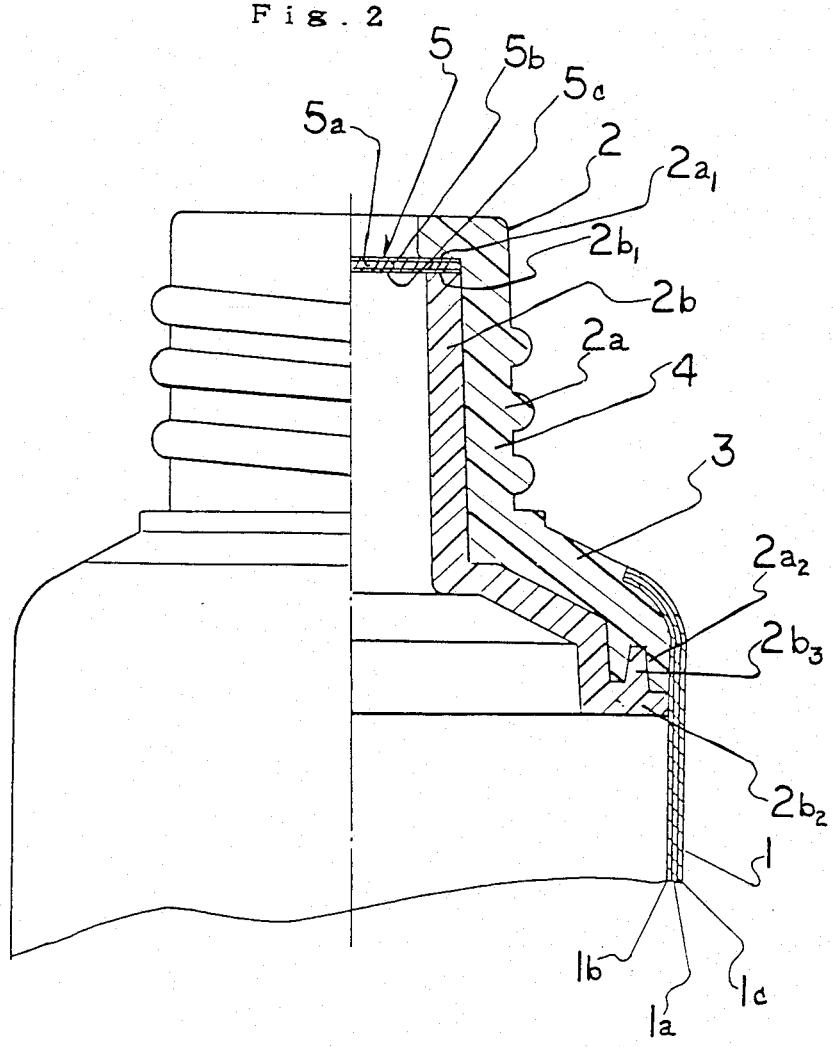
FIG. 2 is a sectional view of another preferred embodiment of the present invention.
Figure 3:
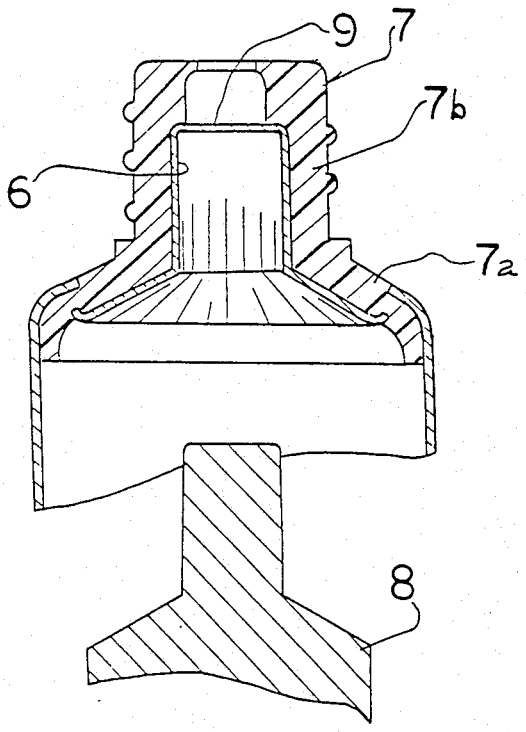
PRIOR ART Fig. 3
FIG. 3 is a sectional view of a conventional tube.
Figure 4:
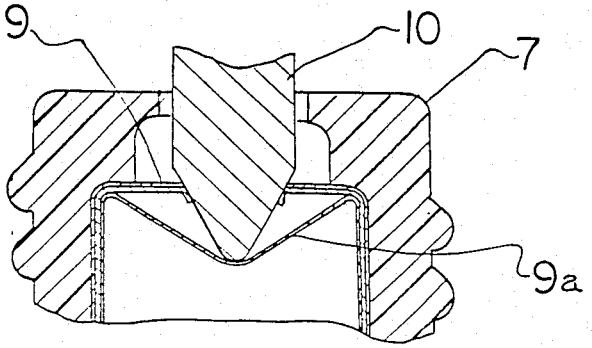
PRIOR ART Fig. 4
FIG. 4 is a sectional view of the conventional tube shown in FIG. 3 in which a blank cap thereof is opened.

A second preferred embodiment of the invention, as shown in FIG. 2 is designed to overcome this potential problem. Referring to FIG. 2, in the second embodiment, the internal layer member 2*b* of the head 2 is provided with a flange member $2b_2$ at the lower end thereof, the flange member $2b_2$ being provided with a ring-shaped engaging convex member $2b_3$ formed on the upper surface thereof, and the outside layer member 2*a* is provided with an engaging concave member $2a_2$ closely engaging the engaging convex member $2b_3$ on the lower end surface thereof. In this preferred embodiment, since the outside layer member 2*a* is firmly connected with the internal layer member 2*b* by closely engaging the engaging convex member $2b_3$ with the engaging concave member $2a_2$, the formation of a gap between the outside layer member 2*a* and the internal layer member 2*b* is prevented even under the expanding action due to internal gas pressure as described above, whereby the property of gas impermeability is maintained even in the present of highly penetrative contents.

In the preferred embodiment as shown in FIG. 2, since the engaging convex member $2b_3$ and engaging concave member engage each other, concave member $2a_2$ may be alternatively formed in the upper surface of the flange member $2b_2$ of the internal layer member and the convex member $2b_3$ may be formed on the lower surface of the outside layer member.

As described above in detail, since a head 2 formed of synthetic resins of a squeeze tube according to the present invention is formed of a bonded body comprising waterproof outside layer member 2*a* and a gas impenetrable internal layer member 2*b*, the requirements of waterproofness and gas tightness can be simultaneously satisfied. In addition, since an upper surface film 5*b* of a blank cap 5 is integrally welded to the outside layer member 2*a*, a gap between the outside layer member 2*a* and the internal layer member 2*b* opening to the outside can be securely sealed by this welded portion and moreover, since a lower surface film 5*c* is formed of urethane- or epoxy-contained synthetic resins having a strong adhesion to aluminium, the blank cap can be broken through by a projection member without stripping the lower surface film 5c. In addition, since urethane- or epoxy-containing synthetic resins have no extensibility comparable to polyethylene, the blank cap can be easily broken through.

Also, according to the present invention, since the laminated aluminium sheet is not extended along the internal surface of the head as in the above described conventional tube, but rather is positioned and fixed as described above, there is no possibility that a resin film layer of the sheet is damaged due to an abnormal extension and bending thereof, causing the metallic (aluminium) layer to be unprotected from corrosion. Thus, the contents can be securely protected by the tube of this invention. In addition, since the blank cap is not extended by drawing and pressing, there is no possibility that the previously mentioned pin hole phenomenon will occur.

While particular embodiments of the invention have been illustrated and described, it will be apparent to those skilled in the art that various changes and modifications can be made without departing from the spirit and scope of the invention, and it is intended that the invention be limited only by the appended claims.

What is claimed is:

1. A collapsible tube, comprising:

a cylindrical body formed of a laminated sheet, said laminated sheet including a metallic layer, an inside synthetic resin layer laminated onto an inside surface of said metallic layer and an outside synthetic resin layer laminated onto an outside surface of said metallic layer;

a head formed of synthetic resin and including a shoulder member fixed on said cylindrical body and a mouth member integrally formed on said shoulder member and having an upper end opening, said head being formed of an inside layer member and an outside layer member bonded to said inside layer member outside of said inside layer member, one of said inside layer member and said outside layer member being formed of a waterproof synthetic resin material, the other of said inside layer member and said outside layer member being formed of a gas-impermeable synthetic resin material, said outside layer member having a receiving seat surface at said opening facing inward of said mouth member, said inside layer member having an upper end surface facing outward of said mouth member;

a membrane cap closing said opening, said membrane cap being formed of a thin laminated sheet including an aluminum sheet having an inward surface facing inward of said mouth member and an outward surface facing outward of said mouth member, a synthetic resin film laminated on said outward surface of said aluminum sheet, and an adhesive resin film laminated on said inward surface of said aluminum sheet, a circumferential edge portion of said laminated sheet being fitted between said upper end surface of said inside layer member and said receiving seat surface of said outside layer member, said synthetic resin film being welded to said outside layer member;

said synthetic resin film being attached to said receiving seat surface;

said inside synthetic resin layer of said cylindrical body being of the same class of synthetic resin materials as the synthetic resin material of said outside layer member of said head, said inside synthetic resin layer of said cylindrical body being of a different class of synthetic resin materials as the inside layer member of said head;

said cylindrical body being integrally connected to said head, with the attachment between the same class of synthetic resin materials of said inside synthetic resin layer of said cylindrical body and said outside layer member of said head being a gas-impermeable attachment, the attachment between the different classes of synthetic resin materials of said inside synthetic resin layer of said cylindrical body and said inside layer member of said head being a gas-permeable attachment; and said head having a flange member at a lower end thereof on said inside layer member, said flange member extending radially outwardly beneath a lower end surface of said outside layer member, one of said flange and said lower end surface having a ring-shaped concave portion extending perpendicularly from a plane containing said radially outwardly extending flange member and into fitting close engagement with a ring-shape convex portion of the other of said flange and said lower end surface, said concave portion and said concave portion being closely engaged with each other, with the attachment between said outside and inside layer members of said head being a gas-impermeable attachment.

2. A collapsible tube as in claim 1, wherein said waterproof synthetic resin material is a material selected from the group of materials consisting of polyethylene and polypropylene, said gas impermeable synthetic resin material is a material selected from the group of materials consisting of thermoplastic synthetic resin materials and thermosetting synthetic resin materials.

3. A collapsible tube as in claim 2, wherein said gas impermeable synthetic resin material is a material selected from the group of materials consisting of polyethylene terephthalate, polybutylene terephthalate, melamine resin, urea resin and phenolic resin.

4. A collapsible tube as in claim 2, wherein said synthetic resin film is formed of a synthetic resin selected from the group consisting of low-density polyethylene and polypropylene and said adhesive resin film is formed of a material selected from the group of materials consisting of a chemically resistant synthetic resin and chemically resistant paints.

5. A collapsible tube as in claim 4, wherein said adhesive resin film is a material selected from the group of materials consisting of urethane type synthetic resins and epoxy-containing synthetic resins.

6. A collapsible tube as in claim 4, wherein said aluminum sheet has a thickness between 20 and 100$\mu$, said synthetic resin film has a thickness between 10 and 50$\mu$, and said adhesive resin film has a thickness between 3 and 15$\mu$.

7. A collapsible tube as in claim 2, wherein said metallic layer of said laminated sheet is formed of aluminum.

8. A collapsible tube as in claim 7, wherein said inside and outside synthetic resin layer of said laminated sheet are formed of materials selected from the group of materials consisting of polyethylene, polypropylene and polyester.

9. A collapsible tube as in claim 1, wherein said gas impermeable synthetic resin material is a material selected from the group of materials consisting of polyethylene terephthalate, polybutylene terephthalate, melamine resin, urea resin and phenolic resin.

10. A collapsible tube as in claim 1, wherein said synthetic resin film is formed of a synthetic resin selected from the group consisting of low density polyethylene and polypropylene and said adhesive resin film is formed of a material selected from the group of materials consisting of a chemically resistant synthetic resins and chemically resistant paints.

11. A collapsible tube as in claim 10, wherein said adhesive resin film is a material selected from the group of materials consisting of urethane type synthetic resins and epoxy-containing synthetic resins.

12. A collapsible tube as in claim 8, wherein said aluminum sheet has a thickness between 20 and 100$\mu$, said synthetic resin film has a thickness between 10 and 50$\mu$, and said adhesive resin film has a thickness between 3 and 15$\mu$.

13. A collapsible tube as in claim 1, wherein said metallic layer of said laminated sheet is formed of aluminum.

14. A collapsible tube as in claim 13, wherein said inside and outside synthetic resin layer of said laminated sheet are formed of materials selected from the group of materials consisting of polyethylene, polypropylene and polyester.

15. A collapsible tube as in claim 1, wherein said synthetic resin film of said membrane cap is welded to said receiving seat surface.

16. A collapsible tube as in claim 1, wherein said outside layer member is formed of said waterproof synthetic resin material and said inside layer member is formed of said gas impermeable synthetic resin material, said inside synthetic resin layer of said cylindrical body being of the same quality as the waterproof synthetic resin material of said outside layer member, said inside synthetic resin layer overlapping said outside layer member on said shoulder member and being welded thereto at a contact surface defined by the overlap, whereby said cylindrical body is integrally connected to said head.

* * * * *